US006565052B1

(12) United States Patent
Doublet

(10) Patent No.: US 6,565,052 B1
(45) Date of Patent: May 20, 2003

(54) DEVICE FOR SUPPORTING A BANNER OR FLEXIBLE PANEL

(75) Inventor: Luc Doublet, Seclin (FR)

(73) Assignee: Ets Doublet, Avelin (FR)

( * ) Notice: Subject to any disclaimer, the term of this patent is extended or adjusted under 35 U.S.C. 154(b) by 0 days.

(21) Appl. No.: 09/555,213

(22) PCT Filed: Nov. 18, 1998

(86) PCT No.: PCT/FR98/02460

§ 371 (c)(1),
(2), (4) Date: Jul. 21, 2000

(87) PCT Pub. No.: WO99/27514

PCT Pub. Date: Jun. 3, 1999

(30) Foreign Application Priority Data

Nov. 26, 1997 (FR) ..... 97 14863

(51) Int. Cl.[7] ..... A47K 1/00

(52) U.S. Cl. ..... 248/218.4; 248/230.8; 248/900; 40/604

(58) Field of Search ..... 248/218.4, 219.2, 248/219.3, 219.4, 230.8, 548, 900; 40/603, 604; 116/173, 174

(56) References Cited

U.S. PATENT DOCUMENTS 783,837 A * 2/1905 Johnston
3,777,428 A * 12/1973 Caufield ..... 52/146
3,850,401 A * 11/1974 Snediker ..... 248/292.13
4,185,360 A * 1/1980 Prete, Jr. et al.
4,880,195 A * 11/1989 Lepley ..... 248/219.4
5,263,675 A * 11/1993 Roberts et al.
5,327,994 A * 7/1994 Smith
5,388,794 A 2/1995 Wolff ..... 248/219.4
5,463,973 A * 11/1995 Tait ..... 116/173
5,632,461 A * 5/1997 Von Helms et al.

FOREIGN PATENT DOCUMENTS

DE 30 05 491 8/1981

* cited by examiner

*Primary Examiner*—Korie Chan
(74) *Attorney, Agent, or Firm*—Connolly Bove Lodge & Hutz LLP

(57) ABSTRACT

A support system for vertically hanging a flexible banner, the system including two horizontally extending arms for supporting a banner tautly. A dampener is connected at an inner end of each respective arm, the dampener including: a) a movable first element on which is fixed a respective horizontally extending arm; b) a fixed bracket second element for securement to a vertical support surface; and c) an intermediary elastic member mounted between the first and second elements.

1 Claim, 2 Drawing Sheets

DEVICE FOR SUPPORTING A BANNER OR FLEXIBLE PANEL

FIELD OF THE INVENTION

The present invention relates to a device for supporting a banner or similar flexible panel in a vertical plane for advertizing or decorative purposes, by tensioning it in such a way that it always remains flat, without forming wrinkles, and simultaneously giving it the ability to withstand windage, especially as the panel is taut and therefore has a relatively rigid flat surface, this panel being constantly returned to its vertical plane.

BACKGROUND OF THE INVENTION

Numerous embodiments of support devices for banners, flags or flexible panels of this kind are already known, these consisting in causing a vertical pole or the like to bear at least one horizontal bracket to which the upper edge of the banner or _fly_ is attached, for example by forming a sewn hem along this edge and engaging the bracket in this hem, or alternatively by attaching this edge to this bracket by eyelets or similar fasteners.

Document U.S. Pat. No. 5,388,794 discloses a device for a flag which comprises two rods borne by a pole, each rod being fitted with a mount, a means of temporary immobilization and a spring for storing up the compressive loadings which result from the lifting of the mounts in reaction to the movement of the flag.

The panel is thus suspended from the bracket and, in the absence of wind, extends in a vertical plane, especially if its opposite lower edge is appropriately weighted. A return line may also be fixed to this lower edge and attached to elsewhere on the pole, below the flexible panel, to limit the flapping movements of the panel. As an alternative, a hem may also be formed in this lower edge as in the upper edge, and into which can be slipped a batten which stiffens the panel and makes it easier to keep in its plane.

However, with these solutions, as soon as the wind speed increases, the thrust of the air which strikes this flexible panel is exerted on it, creating somewhat violent turbulence and in any event creating a force which presses on the panel and tries to drive it along and cause it to twist on itself or even wrap around the pole, thus no longer allowing its surface to be seen, this being accompanied with resulting drawbacks if the panel is an advertizing panel bearing writing or various signs.

BRIEF DESCRIPTION OF THE INVENTION

The subject of the present invention is a device for supporting a flexible panel of the kind described briefly hereinabove, which alleviates these drawbacks, not only by making it possible for the panel to be kept approximately vertical and appropriately taut between its upper and lower edges, but also allowing it to withstand the effects of the wind, by virtue of return means which return the panel to its initial position, opposing the pushing forces exerted on it.

To this end, the support device in question for a banner or similar flexible panel of rectangular overall shape arranged and kept taut in a vertical plane, this panel being secured along its upper and lower edges in this plane to two approximately horizontal rods respectively which form brackets and are capable of immobilizing and stiffening these edges, these rods being borne by a vertical pole or similar element, is characterized in that each horizontal rod is equipped, near the vertical pole, with an element for bearing against this pole, this element being associated with a means of temporary immobilization on the pole, each rod and its bearing element being connected by a spring capable of opposing lateral torque exerted on the rod, constantly returning the latter to the vertical plane of the panel.

According to another feature of the support according to the invention, each element for bearing against the pole belonging to a horizontal rod is made of a rigid and continuous metal wire shaped to form a V-shaped bow, this bow being extended at its open ends by two branches which bear against the lateral surface of the pole along parallel generatrices thereof, one of these branches comprising an element for connecting to the return spring connected to the horizontal rod, the plane which bisects the V-shaped bow coinciding with the vertical plane of the panel.

According to another feature also, each horizontal rod comprises, at the opposite end to its running part connected to the return spring, an end part which forms a very obtuse angle with this running part, so as to keep the corresponding edge of the panel taut.

In a preferred embodiment, the means for temporarily immobilizing the bearing element consist of adjustable straps each comprising a buckle for closing the strap on itself around the vertical pole. Advantageously, the buckle for closing each strap comprises a progressive tensioning mechanism that can be locked in position step by step.

Also as a preference and in this embodiment, each adjustable strap comprises two separate strands which can be connected respectively to the two branches of the V-shaped bow, near the two ends of these branches.

According to yet another feature, the return springs of the two horizontal rods secured respectively to the upper and lower edges of the panel are spiral springs, the V-shaped bows of the bearing elements associated with the two rods being arranged symmetrically one with respect to the other with respect to a horizontal plane extending approximately in the middle of the height of the panel.

Other features of a support device produced in accordance with the invention will become still more apparent through the description which follows of one embodiment, given by way of non-limiting indication with reference to the drawings, in which:

DETAILED DESCRIPTION OF THE INVENTION

Figure 1:
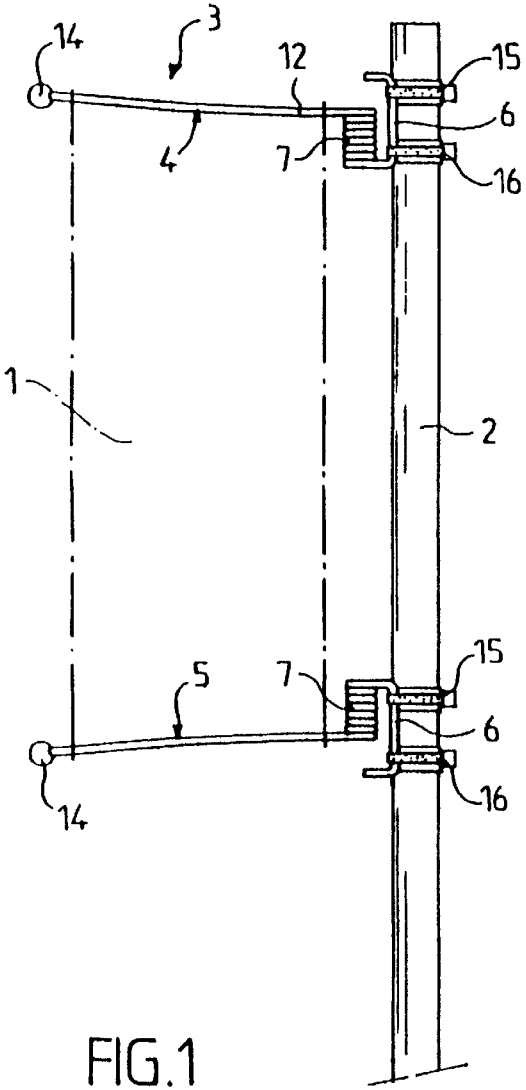
FIG. 1 is a diagrammatic view in elevation of the device in question for supporting a flexible panel using a vertical pole.

In FIG. 1, the reference 1 diagrammatically depicts a banner or flag, more generally a flexible panel that can be used for advertizing or decorative purposes, it being possible for this flexible panel to be made of an appropriate textile material or even of any other similar material with suitable reinforcement that gives it the mechanical strength needed for the envisaged use.

Figure 2:
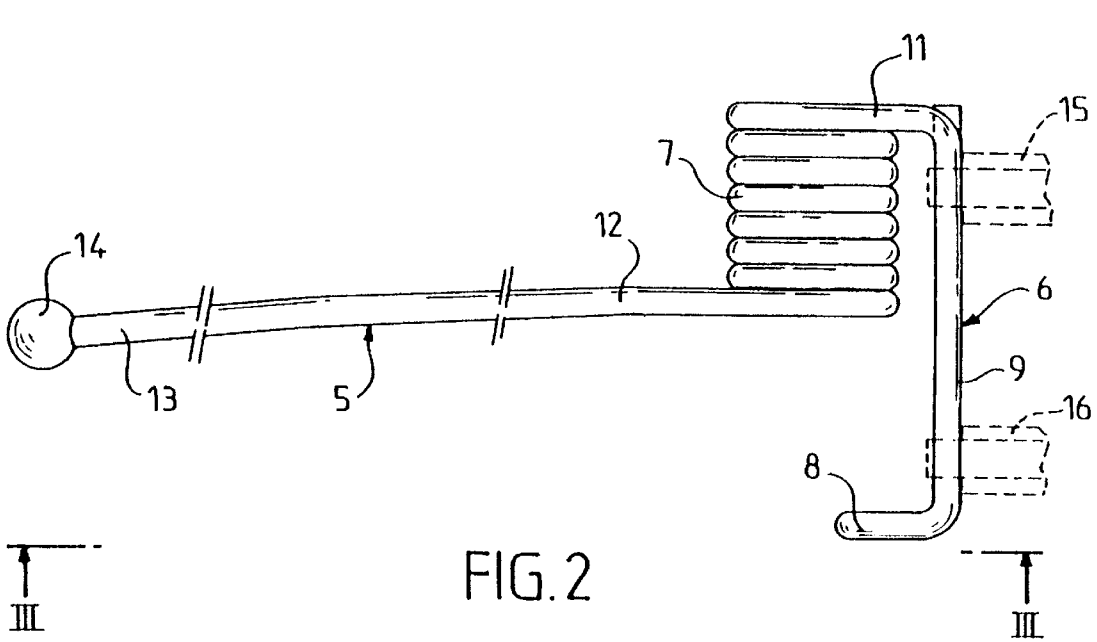
FIGS. 2 and 3 are views on a larger scale, in elevation and from above respectively, of the device in question.
Figure 3:
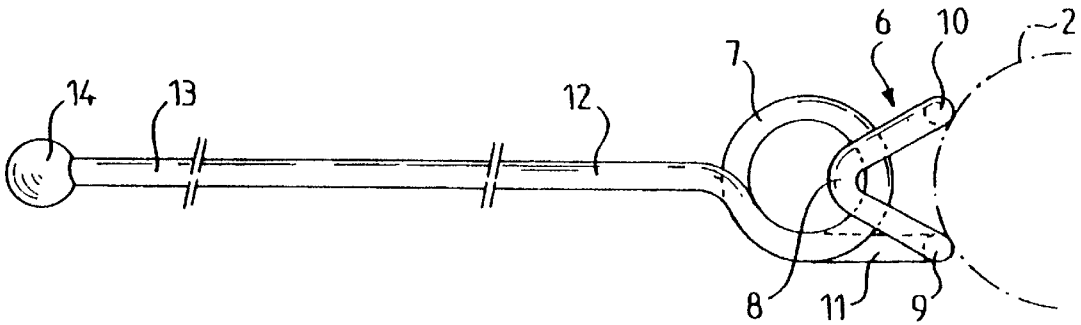
Figure 4:
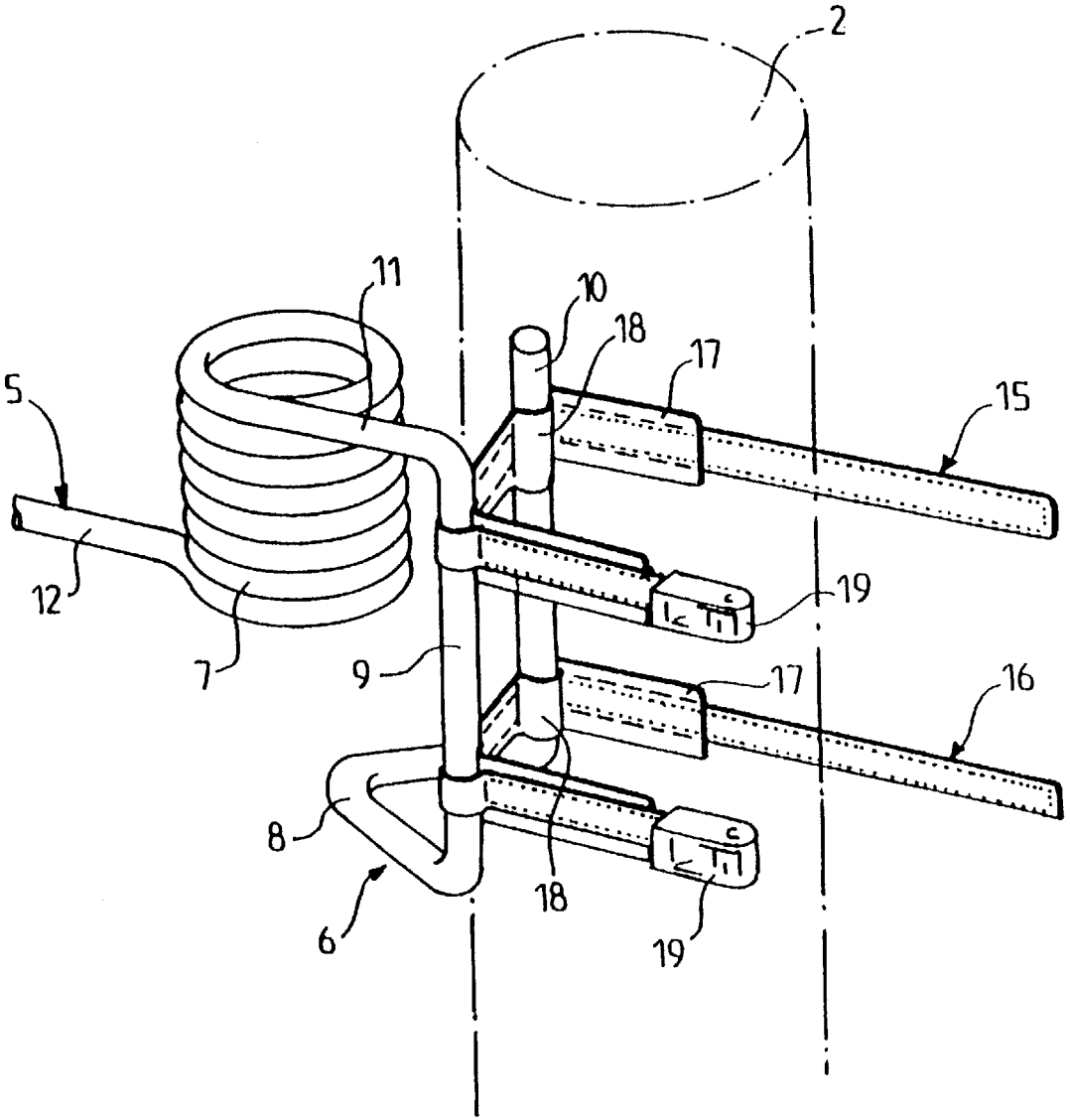
FIG. 4 is a partial perspective view of one of the rods of the device with its spring and its bearing bow, and of the means for immobilizing the latter on the vertical pole.

This panel 1 has a rectangular overall shape and is designed to be supported in a vertical plane by a pole 2 using a device 3 essentially comprising, along its upper and lower edges respectively, two metal rods 4 and 5 forming brackets, extending approximately horizontally and designed each to be secured to the vertical pole 2 by a bearing element 6, each rod being connected to the corresponding bearing element by a spiral spring 7, the structure and implementation of the device 3 emerging more clearly from FIGS. 2 to 4.

As can be seen in particular in FIGS. 2 and 3, which more particularly illustrate the structure of one of the horizontal rods, in this instance the rod 5, it being emphasized that the two rods are strictly identical, this rod consists of a rigid metal wire shaped to produce, as a single piece, with the rod, the bearing element 6 and the return spring 7.

The bearing element 6 is, for example, in the form of a V-shaped bow 8, the open ends of which are extended by two rods, 9 and 10 respectively, which press against the external surface of the vertical pole 2, particularly along two parallel generatrices thereof. One of these rods, in this instance the rod 9, is bent over at 90° to form an element 11 that connects with the return spring 7, which is thus slightly offset laterally with respect to the pole 2.

The return spring 7 thus connects the bearing element 6 to the rod 5, which comprises a horizontal running part 12, extended by an end part 13, which is deflected slightly and forms a very obtuse angle with this running part.

The rods 4 and 5 are secured to the upper and lower edges of the flexible panel 1 by any appropriate means. As a preference, this panel has a sewn or otherwise formed hem in these edges, into which hem can be slipped the corresponding rod, of which the end opposite the return spring 7 may advantageously be threaded to take an end ball 14 for holding the panel on its rods and preventing it from slipping off them and inadvertently escaping.

The rods 4 and 5 of the device for supporting the panel 1 are also fixed to the pole 2 by means of an assembly which advantageously comprises two adjustable straps 15 and 16 as illustrated more particularly in FIG. 4.

Advantageously, each of these straps is secured to a connecting and reinforcing band 17 with eyelets 18 allowing these bands to be slipped over the branches 9 and 10 of the bearing element 6, particularly so that each of these straps can be arranged near the ends of these branches before these surround the pole and are tightened against it by means of a buckle 19, preferably the kind of buckle which is tightened gradually and the tension created locked off stepwise.

As can be seen incidentally in FIG. 1, the two rods 4 and 5 of the support device 3 are thus fixed to the vertical pole 2 and fitted to it in such a way that the panel 1 is kept appropriately taut between these rods in a vertical plane, which is approximately the plane which bisects the V-shaped bows 8 of each of the rods on the pole. Furthermore, the bearing elements 6 and the return springs 7 for the two rods are arranged symmetrically on each side of the vertical mid-plane of the panel, so that the end parts 13 of these rods exert on the ends of the upper and lower edges of the panel 1, because of the angle they make with the running parts 12 of these rods, an increased tensile force keeping the panel perfectly flat in its vertical plane.

When there is no wind, the writing or various signs borne by the panel can thus be perfectly legible from the outside.

When the strength of this wind increases and creates a thrust on the panel, the torsion exerted on the rods is then stored up in the springs 7, the bows 8 remaining constantly pressed against the pole by the straps 15 and 16. These springs in turn exert a return torque on the panel so that the latter is constantly returned to its vertical plane with no risk of it twisting and, in particular, wrapping around the pole.

This thus produces a device of simple, effective and inexpensive design allowing optimum use of advertizing or other panels, even in a turbulent environment where winds are appreciable.

Of course, it goes without saying that the invention is not in any way restricted to the embodiment more particularly described hereinabove with reference to the appended drawings; on the contrary, it encompasses all alternative forms thereof.

What is claimed is:

1. A support device for an attachable banner or similar flexible panel of rectangular overall shape arranged and kept taut in a vertical plane, this panel being secured along an upper edge and a lower edge in said vertical plane, the device comprising; two approximately horizontal rods which are capable of immobilizing and stiffening said edges, said horizontal rods being borne by a vertical pole, wherein each one of said horizontal rods is equipped, near the vertical pole, with an integrally formed bearing element for bearing against the vertical pole, said element being temporarily immobilized on the vertical pole, each one of said rods and a corresponding bearing element being connected by an integrally formed return spring capable of opposing lateral torque exerted on the horizontal rods, constantly returning the latter to the vertical plane of the panel, wherein each of said bearing elements belonging to said horizontal rods is made of a rigid and continuous metal wire shaped to form a V-shaped bow, said V-shaped bow being extended at open ends thereof by two branches which bear against a lateral surface of the vertical pole along parallel generatrices thereof, one of said branches comprising an element for connecting to the return spring connected to the horizontal rod, a plane which bisects the V-shaped bow coinciding with a vertical plane of the panel.

* * * * *